United States Patent [19]

Gabioud

[11] Patent Number: 4,988,910

[45] Date of Patent: Jan. 29, 1991

[54] ELECTRON POWER TUBE COOLED BY CIRCULATION OF A FLUID

[75] Inventor: André Gabioud, Thonon Les Bains, France

[73] Assignee: Thomson-CSF, Paris, France

[21] Appl. No.: 314,145

[22] Filed: Feb. 23, 1989

[30] Foreign Application Priority Data

Feb. 26, 1988 [FR] France ..... 88 02363

[51] Int. Cl.[5] ..... H01J 7/26; H01J 61/52

[52] U.S. Cl. ..... 313/35; 313/22; 313/24; 313/36; 313/39; 313/43

[58] Field of Search ..... 313/35, 43, 22, 24, 313/36, 39, 30

[56] References Cited

U.S. PATENT DOCUMENTS

| | | | |
|---|---|---|---|
| 2,829,290 | 4/1958 | van Warmerdam | 313/45 |
| 2,935,306 | 5/1960 | Beurtheret | 257/250 |
| 4,639,633 | 1/1987 | Hoet et al. | 313/35 |
| 4,644,217 | 2/1987 | Hoet et al. | 313/35 |

FOREIGN PATENT DOCUMENTS

| | | |
|---|---|---|
| 1132439 | 11/1956 | France . |
| 1334976 | 7/1963 | France . |

*Primary Examiner*—Donald J. Yusko
*Assistant Examiner*—Michael Horabik
*Attorney, Agent, or Firm*—Oblon, Spivak, McClelland, Maier & Neustadt

[57] ABSTRACT

A power electron tube cooled by the circulation of a fluid is disclosed. This tube comprises a hollow, cylindrical anode mounted coaxially around a hollow, cylindrical grid, itself surrounding a cathode. The interior of the anode is hermetically closed. A cooler with forced fluid circulation is formed by two coaxial, cylindrical jackets mounted around the anode. It defines a closed chamber connected to an inlet conduit and a removal conduit for the fluid. An electrical connection part for the anode is brazed, by one side, to the base of the anode and, by the other side, to a part that is solidly joined to the outer jacket of the cooler. This anode connection part forms an impervious wall closing the chamber of the cooler, and is in contact with the cooling fluid.

7 Claims, 2 Drawing Sheets

ELECTRON POWER TUBE COOLED BY CIRCULATION OF A FLUID

BACKGROUND OF THE INVENTION

1. Field of the Invention

The present invention concerns a electron power tube, for example of the triode, tetrode or pentode type, cooled by the circulation of a fluid. In particular, it concerns means to improve the cooling of the anode connection part.

2. Description of the Prior Art

In electron tubes of this type, a cathode emits a flow of electrons towards an anode. This flow of electrons is modulated by one or more grids before reaching the anode. The kinetic energy of the electrons is converted into heat at the anode. For electron power tubes, the energy to be dissipated may be so high that it becomes necessary to use cooling devices working with a fluid under forced circulation. This fluid is often air, for low power values, and a liquid, notably water, for high power values.

Power electron tubes generally have the following configuration. In the case of a triode with directly heated cathode, for example: the cathode is shaped like a cylinder having, for its axis, the longitudinal axis of the tube. Then, there is a grid that surrounds the cathode and, finally, an anode which surrounds the grid. The heated part of the cathode constitutes, along the longitudinal axis, an active electron-emitting length: the electrons go through the grid along radial directions and are picked up by the anode. The anode and the grid are each shaped like a hollow cylinder, and each of them has, at its base, on the foot side of the tube, a cylindrical part for external electrical connection. These anode and grid connection parts are solidly joined together, mechanically, by being sealed to one and the same insulating tie. The anode forms a part of the imperviously sealed chamber, within which is set up the vacuum needed for the working of the electron tube.

The tube is cooled by means of a cooler, formed by two coaxial, cylindrical jackets mounted around the anode, one end of the outer jacket being fixed imperviously to a flange of the tube, located on the foot side of this tube. The outer jacket is provided with an inlet conduit through which comes the cooling fluid, water for example.

The circulation of water is forced, and the water circulates, for example, between the outer jacket and the inner jacket up to the base of the external jacket, where the water is injected and advances between the space formed between the inner jacket and the external wall of the anode. The transfer of calories to the water takes place in this zone. The water is then removed by means of a second conduit with which the inner jacket is provided.

The efficiency with which the anode is cooled is related, in a manner known per se , to the characteristics of flow of the cooling fluid, notably to the pressure with which the water is injected into the cooler and to the dimensions of the space btween the inner jacket and the external wall of the anode.

The above-described configuration has one disadvantage: the elements located near the anode tend to undergo a high rise in temperature due to thermal conduction. This is the case, in particular, for the anode connection part.

The anode connection part provides both the external electrical connection of the anode and the mechanical connection with the insulating tie that separates it from the grid connection part. This insulating tie is prefer ably made of ceramic.

The microwave currents circulate on the surface of the conductors, on a thickness which is all the smaller as their frequency is high. This phenomenon is known as skin effect. The rise in the frequency leads to an increase in losses by Joule effect, more particularly at the connection between the anode connection part and the insulating tie.

For, at this place, because of the metal/ceramic sealing, the level of losses can be reduced only by resorting, as in the rest of the part, to a surface coating which is a good conductor of electricity, such as copper for example.

The intense heating of the anode connection part may be detrimental to the electron tube. This heating is due to heat conduction and to Joule effect. The materials forming the anode connection part and the insulating tie, namely the metal and the ceramic, have different behaviour characteristics the more the temperature rises. The mechanical strains induced in these materials then entail the risk of causing breakage either of the metal/ceramic sealing or in the insulating space itself.

SUMMARY OF THE INVENTION

The invention is aimed at overcoming this drawback by enabling the temperature of the anode connection part to be stabilized at an acceptable level.

The invention consists in diverting all or a part of the anode cooling fluid, in order to provide for circulation of fluid on the anode connection part, especially at the ceramic/metal sealing zone.

The invention proposes a electron power tube comprising:

a hollow, cylindrical anode mounted coaxially around a hollow cylindrical grid, itself surrounding a cathode, the inside of the anode being hermetically closed and subjected to vacuum;

a cylindrical part for the electrical connection of the anode, said cylindrical part being brazed by one side to the base of the anode;

a cooler with forced circulation of fluid, formed by two cylindrical, coaxial jackets, mounted around the anode and defining a closed chamber, connected to an inlet conduit and a removal conduit for the fluid, wherein the anode connection part is brazed, by the other side, to a part that is solidly joined to the outer jacket of the cooler, and wherein this anode connection part forms, between these two sides, an imperviously sealed wall which closes the chamber of the cooler and is in contact with the cooling fluid.

In principle, it is provided that the anode connection part is, moreover, solidly joined to an insulating tie, acting as a support for a grid connection part and providing imperviousness to the vacuum within the anode. It is then seen to it that the region where the anode connection part is sealed to the tie is in contact with the cooling fluid.

In two embodiments, the part solidly joined to the outer jacket is a flange brazed to the base of the anode. Holes go through it, and these holes divert the flow of the cooling fluid either partially or totally towards the anode connection part in order to cool it.

In another embodiment, the part solidly joined to the outer jacket is a ring. The anode connection part is in contact with all the cooling fluid. The anode connection part completely provides the mechanical link between the anode and the ring and, consequently, between the anode and the outer cooling jacket.

BRIEF DESCRIPTION OF THE DRAWINGS

The invention will be better understood from the following description, made as a non-restrictive example, and from the appended figures, of which.

In these figures, the same references designate the same elements. But, for reasons of clarity, the dimensions and proportions of the different elements have not been kept.

DESCRIPTION OF PREFERRED EMBODIMENTS

Figure 1:
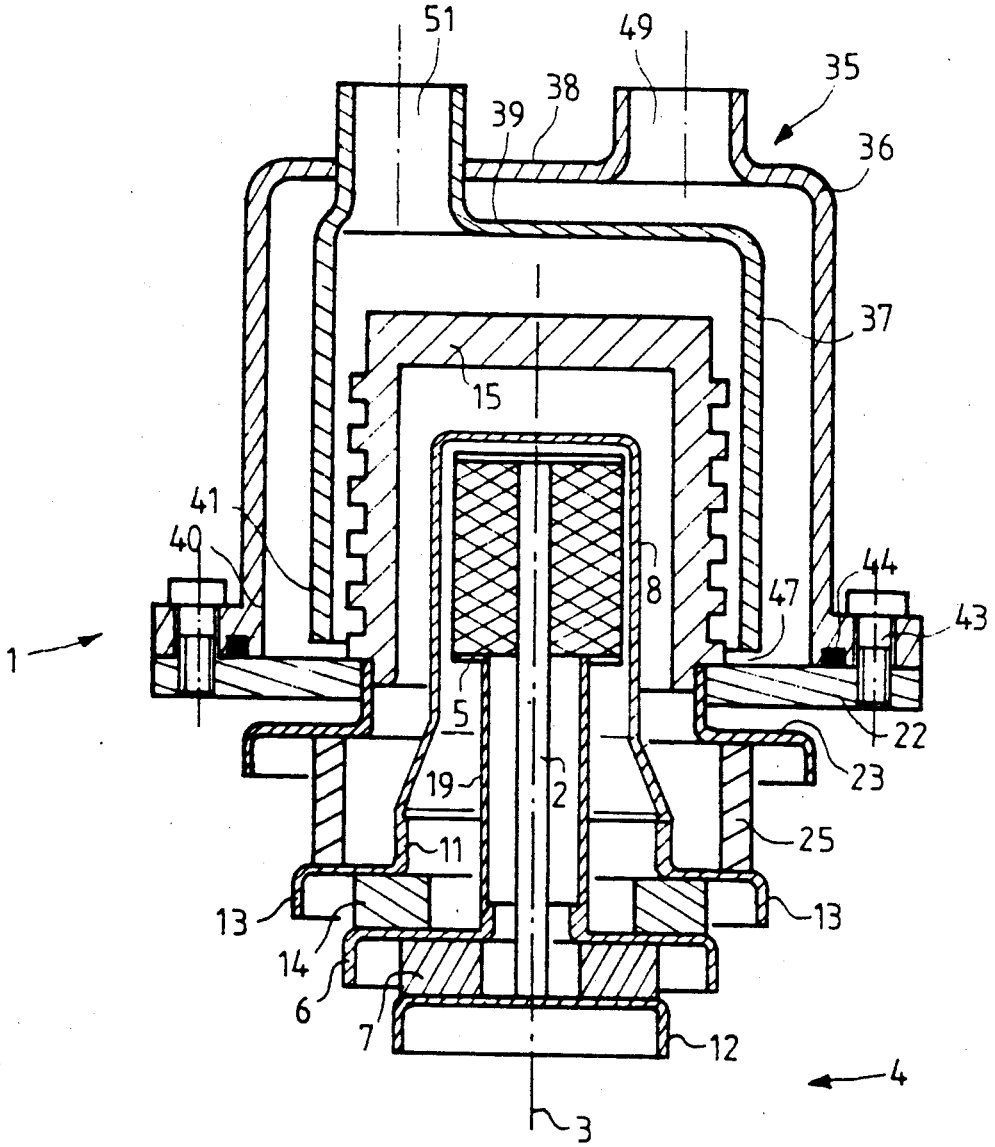
FIG. 1 is a sectional view of an electron tube cooled according to the prior art.

FIG. 1 shows a sectional view of a prior art electron tube 1 of the directly heated triode type.

The tube 1 comprises a directly heated, cylindrical cathode 5 having, for its axis 3, a longitudinal axis of the tube 1.

The cathode 5 is mounted in a conventional way as shown in the figure: it is fixed, on a foot 4 side of the tube, firstly, to a central rod 2 and, secondly, to a tubular support 19. Through this rod 2 and this support 19, it is electrically connected to a first connection part and a second connection part, 12 and 6. These connection parts 12, 6 are metallic and are solidly joined to each other, mechanically, by an insulating tie 7. A grid 8 surrounds the cathode 5. The grid 8 has the shape of a hollow cylinder having, for its axis, the longitudinal axis 3.

The end 11 of the grid, which is on the tube foot 4 side, is connected to a third connection part 13 which is solidly joined to the second connection part 6 by an insulating tie 14. Then, around the grid 8, there is an anode 15 which forms a part of a chamber, within which is set up the vacuum needed for the working of the tube. The anode 15 has the general shape of a hollow cylinder having, for its axis, the longitudinal axis 3. One end of this hollow cylinder, located towards the tube 4 foot, is joined by brazing, firstly to a flange 22 and, secondly, to a fourth connection part 23, which is itself solidly joined, by an insulating tie 25, to the grid connection 13. All the insulating ties are cylindrical and are preferably made of ceramic. The links between the connection parts and the insulating ties are seals.

It will be noted that, in the prior art, the anode connection part is soldered only at the anode 15 and the insulating tie 25.

The electron tube 1 further has a cooler 35 mounted around the anode 15. This cooler 35 is formed by two generally cylindrical, coaxial jackets 36, 37, each having a first closed end 38, 39 and a second open end 40. 41. The external jacket 36 is fixed at its base, by its open end 40, to the flange 22 in a tightly sealed way, by means of screws 43 and a seal 44.

The open end 41 of the inner jacket 37 is non-contiguous with the flange 22, so as to form an opening 47, enabling the passage of a cooling fluid.

The closed end 38 of the outer jacket 36 has an inlet nozzle 49, through which a fluid under pressure, for example water, is injected in a standard way. The water circulates between the outer jacket 36 and the inner jacket 37, and is injected, at the opening 47, into a chamber formed by the inner jacket 37 and the anode 15. The water is then discharged by an outlet nozzle 51, placed at the closed end 39 of the inner jacket 37.

We shall now describe the modifications provided by the present invention.

Figure 2:
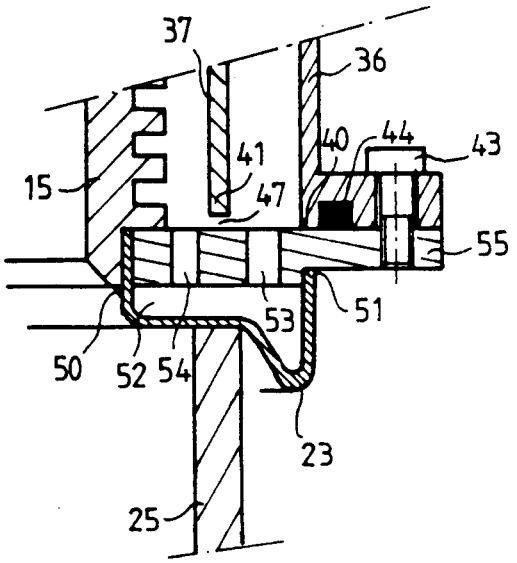
FIGS. 2, 3 and 4 are sectional views of three variants of the system, according to the invention, for the anode connection part.

FIG. 2 shows a partial sectional view of the system, according to the invention. The figure shows only a zone in the vicinity of the anode connection, and the rest of the structure may be identical to that described with reference to FIG. 1.

The base 40 of the outer jacket 36 of the cooler is fixed, imperviously, by means of screws 43 and a seal 44 for example, to the upper face of a flange 55. The flange 55 is fixed to the outer jacket 36 of the cooler on its outer periphery side, while its inner periphery is brazed to the anode 15.

The connection part 23 is still brazed by one side 50 to the base of the anode 15, while the other side 51 itself is brazed to the lower side of the flange 55. It is still solidly joined to the insulating tie 25 by a ceramic/metal sealing The brazings of the anode connection part 23 provide for the imperviousness of a chamber 52, formed between the anode connection part 23 and the lower face of the flange 55.

The anode connection part 23, thus mounted, provides for imperviousness between the cooling circuit and the outside of the tube and between the cooling circuit and the inside of the electron tube.

The cooling water circulates in the chamber 52 through holes crossing the flange 55. FIG. 2 is a section through two of these holes, designated by 53 and 54. The hole 53 acts as an inlet hole because it is located on the flange 55 between the outer jacket 36 and the inner jacket 37.

The hole 54 acts as an outlet hole because it is located on the flange 55, between the inner jacket 37 and the anode 15.

The open end 41 of the inner jacket 37 is non-contiguous with the flange 55, in order to form an opening 47, designed for the passage of a part of the cooling water.

This embodiment provides for a partial diversion of the cooling water from the main circuit. For, the water can always pass through the opening 47. The flow-rate of the water needed for the cooling of the anode connection part 23, particularly at the position of the sealing with the insulating tie, can be controlled, especially at the position of the sealing with the insulating tie 25, by acting on the ratio of charge losses of the diverted circuit and of the main circuit and, also, on the dimensions of the opening 47.

Figure 3:
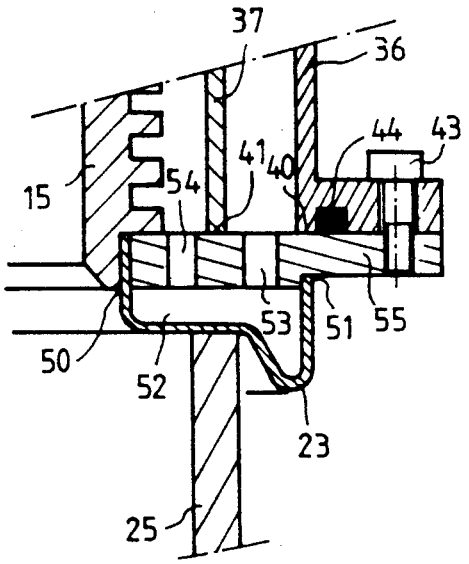

FIG. 3 shows a sectional view of another embodiment of the cooling circuit according to the invention.

In this embodiment, the end 41 of the inner jacket 37 of the cooler is now contiguous with the upper surface of the flange 55. The total imperviousness of this connection is not necessary. The two parts are in contact, but it is also possible to braze them. There are no other changes in the assembly of the other parts, as compared with that described in FIG. 2.

All the cooling water now comes into contact with the connection part 23 of the anode 15.

Figure 4:
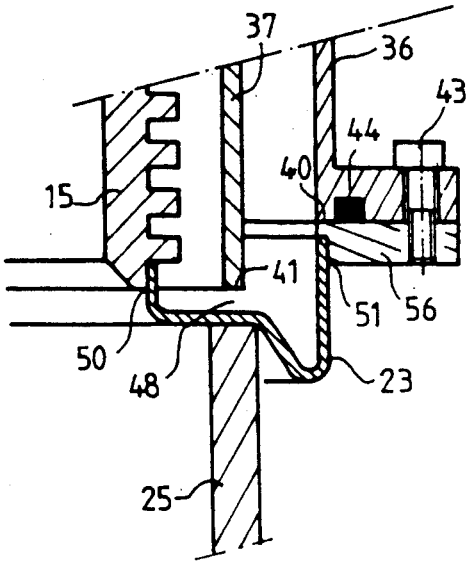

FIG. 4 shows a sectional view of another embodiment of the cooling circuit according to the invention.

In this embodiment, the connection part 23 of the anode 15 is still brazed, by one side 50, to the base of the anode 15 and, by the other side 51, to the inner flank of a ring 56 which is solidly joined to the base of the outer jacket 36 of the cooler.

The base 40 of the outer jacket 36 of the cooler is fixed imperviously, by means of screws 43 and a seal 44, to the upper face of the ring 56. The ring 56 is not connected to the anode 15.

The connection part 23 forms, between its two sides, an impervious wall closing the chamber of the cooler.

The open end 41 of the inner jacket 27 is non-contiguous with the anode connection part 23, in order to form an opening 48 designed for the injection of cooling water.

In this configuration, the water is injected into the cooling circuit of the anode 15 at the point where the connection part 23 of the anode 15 is sealed to the insulating tie 25. The cooling efficiency is maximum. But it is the anode 15 connection part that fully provides the mechanical bond between the anode and the outer jacket 36 of the cooler.

The invention is not restricted to the above-described configurations.

In particular, it is possible for the anode connection part to be brazed on one side, to the base of the anode and to be brazed, on the other side, directly to the base of the outer jacket of the cooler. The presence of a flange (55) or a ring (56) is no longer necessary.

What is claimed is:

1. A power electron tube comprising:

substantially coaxial electrodes including an anode having an interior, hermetically closed space subject to a vacuum, the anode being positioned external to a grid surrounding a cathode;

a substantially circular anode connection part for external electrical connection of the anode, the anode connection part having first and second ends and first and second main faces, the first end of the anode connection part being connected to the anode and a portion of the first main face of the anode connection part being sealed, at a sealing zone, to one end of an insulating tie having another end thereof joined to one of the coaxial electrodes different from the anode, the anode connection part and the insulating tie closing a portion of the interior, hermetically closed space of the anode; and a cooler providing forced circulation of a cooling fluid and formed by substantially coaxial inner and outer jackets mounted around the anode and defining a closed chamber, the anode connection part being brazed at the second end thereof to a part which is solidly joined to the outer jacket, the anode connection part closing a portion of the closed chamber of the cooler and the cooling fluid circulating along at least a portion of the second main face of the anode connection part adjacent to the insulating tie to cool the sealing zone between the insulating tie and the anode connection part.

2. A power electron tube according to claim 1, wherein the part solidly joined to the outer jacket of the cooler is a flange brazed to the base of the anode, said flange having holes, at least one of which is located between the inner jacket and the outer jacket of the cooler, and at least another one of which is located between the inner jacket of the cooler and the outer wall of the anode.

3. A power electron tube according to claim 2, wherein there is an opening between the end of the inner jacket of the cooler and the upper surface of the flange, so that the circulation of the cooling fluid is partially diverted by the holes of the flange.

4. A power electron tube according to claim 2, wherein the end of the inner jacket of the cooler is contiguous with the upper surface of the flange so that the circulation of cooling fluid is totally diverted by the holes of the flange.

5. A power electron tube according to claim 1, wherein the part solidly joined to the outer jacket of the cooler is a ring and wherein the anode connection part is brazed, by one side, to the inner flank of this ring, the other side being brazed to the base of the anode, the mechanical connection between the anode and the outer jacket of the cooler being provided by the anode connection part.

6. A power electron tube according to claim 5, wherein there is an opening between the end of the inner jacket of the cooler and the anode connection part, enabling the passage of the cooling fluid.

7. A power electron tube according to claim 1, wherein the first and second main faces of the anode connection part are substantially opposed one another.

* * * * *